US011548746B2

(12) United States Patent
Ichikawa

(10) Patent No.: US 11,548,746 B2
(45) Date of Patent: Jan. 10, 2023

(54) CONVEYING DEVICE AND IMAGE FORMING APPARATUS

(71) Applicant: Konica Minolta Inc., Tokyo (JP)

(72) Inventor: Katsuhisa Ichikawa, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 337 days.

(21) Appl. No.: 16/882,176

(22) Filed: May 22, 2020

(65) Prior Publication Data

US 2020/0391967 A1 Dec. 17, 2020

(30) Foreign Application Priority Data

Jun. 11, 2019 (JP) ..... JP2019-108645

(51) Int. Cl.
*B65H 5/36* (2006.01)
*B65H 5/06* (2006.01)

(52) U.S. Cl.
CPC ..... *B65H 5/36* (2013.01); *B65H 5/062* (2013.01); *B65H 2404/513* (2013.01); *B65H 2404/6111* (2013.01); *B65H 2404/621* (2013.01); *B65H 2701/1916* (2013.01)

(58) Field of Classification Search
CPC .... B65H 5/062; B65H 5/36; B65H 2404/621; B65H 2404/6111; B65H 2701/1916
See application file for complete search history.

(56) References Cited

U.S. PATENT DOCUMENTS 8,322,714 B2 * 12/2012 Satomi ..... B65H 5/38 271/264
8,403,324 B2 * 3/2013 Shirakata ..... B65H 5/36 271/226
9,950,885 B2 * 4/2018 Mizuguchi ..... B65H 29/52
11,247,860 B2 * 2/2022 Yamada ..... B65H 5/36
2016/0194167 A1 * 7/2016 Mizuguchi ..... B65H 29/52 271/2
2022/0011711 A1 * 1/2022 Shiokawa ..... G03G 15/6576

FOREIGN PATENT DOCUMENTS

JP H05-254690 A 10/1993

* cited by examiner

*Primary Examiner* — Patrick Cicchino
(74) *Attorney, Agent, or Firm* — Squire Patton Boggs (US) LLP

(57) ABSTRACT

A conveying device includes: a first conveyance member that is provided upstream of the conveyance path; a guide member that is disposed, along the conveyance path, downstream of the first conveyance member in the conveying direction; and a second conveyance member that is disposed downstream of the guide member in the conveying direction and conveys the envelope guided by the guide member, downstream in the conveying direction, wherein the guide member has a flapper relief that has retracted away from the conveyance path such that a rise portion of the flapper generated due to the curve of the conveyance path passes through the flapper relief.

9 Claims, 9 Drawing Sheets

FIG. 4A1
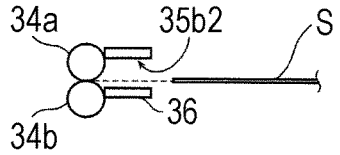
FIG. 4A2
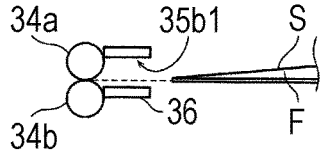
FIG. 4A3
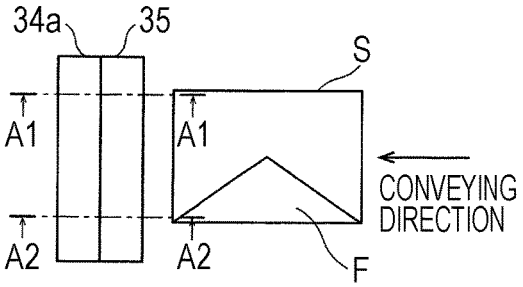
FIG. 4B1
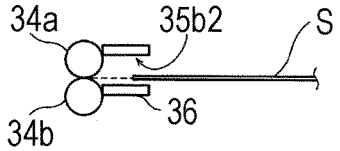
FIG. 4B2
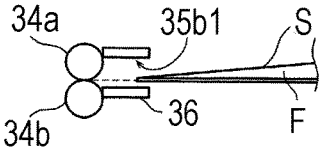
FIG. 4B3
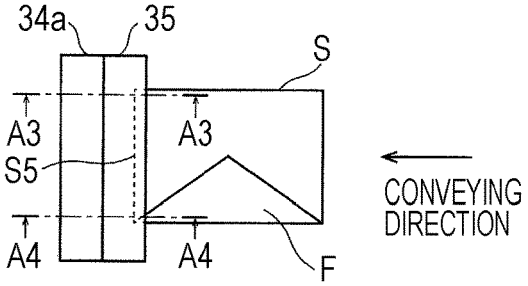
FIG. 4C1
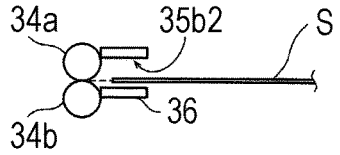
FIG. 4C2
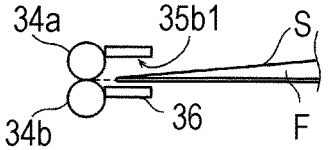
FIG. 4C3
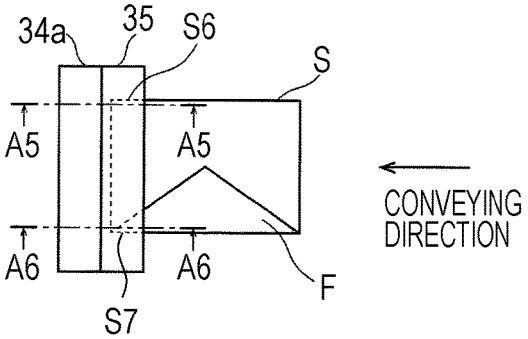
FIG. 4D1
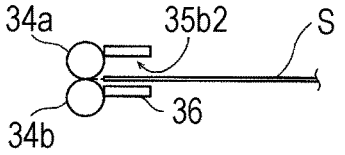
FIG. 4D2
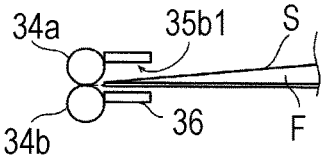
FIG. 4D3
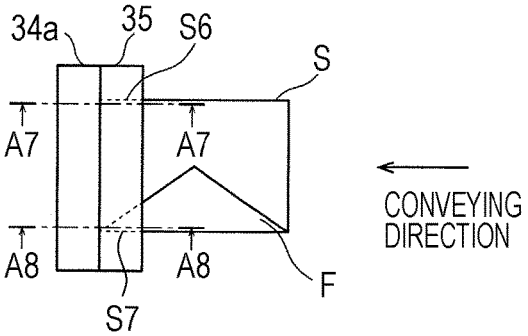

FIG. 9A1
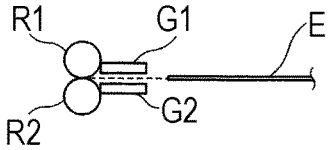
FIG. 9A2
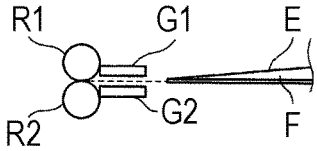
FIG. 9A3
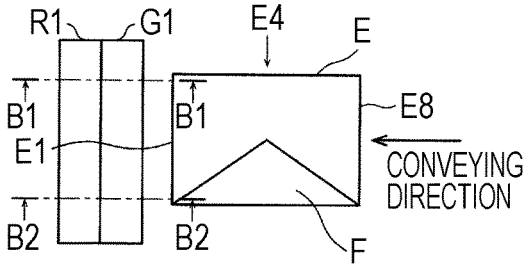
FIG. 9B1
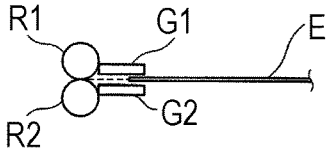
FIG. 9B2
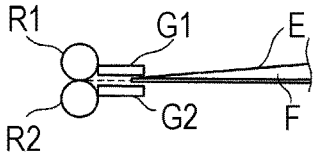
FIG. 9B3
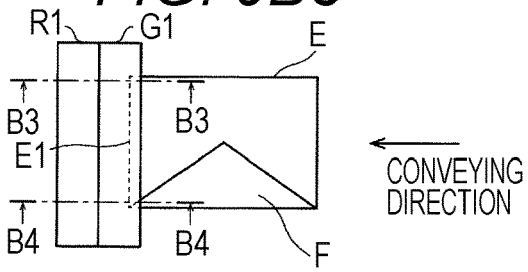
FIG. 9C1
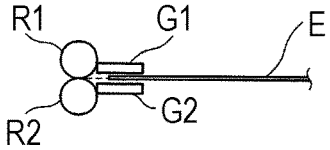
FIG. 9C2
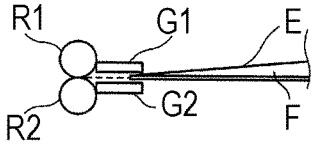
FIG. 9C3
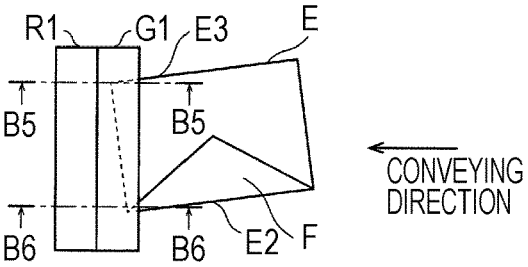
FIG. 9D1
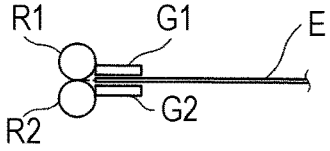
FIG. 9D2
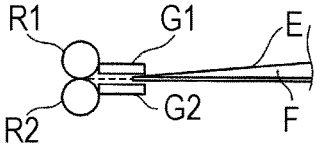
FIG. 9D3
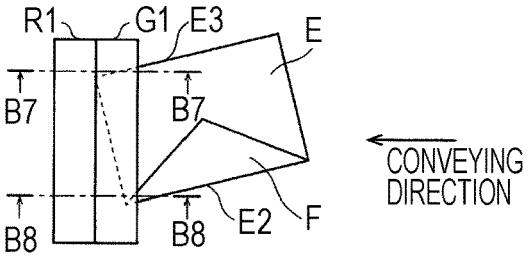
FIG. 9E
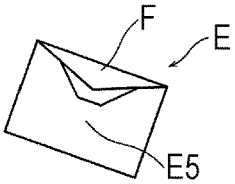
FIG. 9F
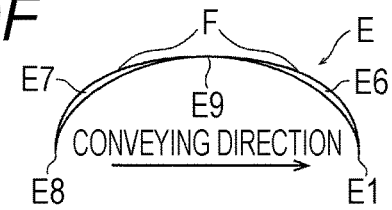

CONVEYING DEVICE AND IMAGE FORMING APPARATUS

The entire disclosure of Japanese patent Application No. 2019-108645, filed on Jun. 11, 2019, is incorporated herein by reference in its entirety.

BACKGROUND

Technological Field

The present invention relates to a technique of passing an envelope through a curved conveyance path in an image forming apparatus.

Description of the Related Art

An image forming apparatus such as a copier or a printer conveys a sheet by a pair of sheet feeding rollers, and a pair of registration rollers, and the like from a sheet feeding cassette that accommodates the sheet. Then, the image forming apparatus feeds the sheet to an image former, forms an image on the sheet at the image former, and discharges the image-formed sheet outside the image forming apparatus.

According to JP 05-254690 A, a configuration is made such that a sheet conveyance path from a pair of sheet feeding rollers to a pair of registration rollers is as straight as possible. With this arrangement, even though a stiff envelope or the like can be reliably guided to a nip between the pair of registration rollers.

However, depending on the disposition of the sheet feeding cassette and the image former in the image forming apparatus, the sheet conveyance path may be curved. When an envelope having a flapper folded passes through such a curved conveyance path, there may be a disadvantage that the conveyed envelope skews as described below.

As illustrated in FIG. 9E, an envelope E has a flapper F folded. A portion of the envelope E other than the flapper F is referred to as an envelope main body E5 of the envelope E. Further, of the front face and the back face of the envelope E, the face on the side where the flapper F is folded is referred to as a flapper face. An envelope having such a shape is referred to as a diamond shape.

For example, consider a case where a pair of sheet feeding rollers conveys the envelope E toward a pair of registration rollers, from a sheet feeding cassette that horizontally accommodates the envelope E, via a vertically and upward curved conveyance path.

Here, in FIGS. 9A1, 9A2, 9B1, 9B2, 9C1, 9C2, 9D1, and 9D2, the envelope being conveyed in a curved posture is straightened, in order to clearly illustrate a floating degree of the flapper F.

FIG. 9F is a schematic cross-sectional view of the envelope E that is conveyed along the curved conveyance path, viewed in the direction of an arrow E4 in FIG. 9A3. As illustrated in this figure, the envelope E that is conveyed along the curved conveyance path has the flapper F open on the side close to a front end E1 of the envelope E, and a gap E6 has occurred between the flapper F and the envelope main body E5. Further, the flapper F is open on the side close to a rear end E8 of the envelope E, and a gap E7 has occurred between the flapper F and the envelope main body E5. On the other hand, at a central portion E9 of the envelope E and the periphery of the central portion E9, the flapper F is in close contact with the envelope main body E5 and closed.

While the envelope E is present in the curved conveyance path, as illustrated in FIGS. 9A1 to 9A3, guide members G1 and G2 guide the envelope E having the flapper F toward registration rollers R1 and R2, respectively.

When the envelope E is further conveyed toward the registration rollers R1 and R2, as illustrated in FIGS. 9B1 to 9B3, the front end E1 of the envelope E having the flapper F partially open enters between the guide members G1 and G2.

The flapper F of the envelope E is open (gap E6 in FIG. 9F). Thus, of both sides E2 and E3 of the envelope E, the thickness of the side E2 where the envelope E has the flapper F is thicker than the interval between the guide members G1 and G2 (FIGS. 9C1 to 9C3). When the envelope E is further conveyed toward the registration rollers R1 and R2, as illustrated in FIGS. 9C1 to 9C3, the side E2 where the envelope E has the flapper F receives resistance from the guide members G1 and G2. On the other hand, the side E3 where the envelope E does not have the flapper F is conveyed toward the registration rollers R1 and R2 without receiving the resistance from the guide members G1 and G2.

When the envelope E is further conveyed toward the registration rollers R1 and R2, as illustrated in FIGS. 9D1 to 9D3, the side E2 where the envelope E has the flapper F receives resistance from the guide members G1 and G2. On the other hand, a front end of the side E3 where the envelope E does not have the flapper F comes into contact with the registration rollers R1 and R2.

As described above, when the envelope E is conveyed toward the pair of registration rollers while the envelope E is present in the curved conveyance path, the flapper is open and the envelope skews due to the gaps that have occurred between the flapper and the envelope main body. When an image is formed on a face of the skewed envelope, there may be a disadvantage that the image is formed obliquely to each side of the envelope.

SUMMARY

An object of the present invention is to provide a conveying device and an image forming apparatus that solve this advantage and are capable of preventing skew of an envelope in a case where the envelope passes through a curved conveyance path.

To achieve the abovementioned object, according to an aspect of the present invention, there is provided a conveying device that conveys an envelope along a curved conveyance path, the envelope having a flapper simply folded, the envelope being non-sealed, the envelope having a side where the flapper is present, the side being in agreement with a conveying direction, the envelope having a front face where the folded flapper is present, the front face being directed outside the curve of the conveyance path, and the conveying device reflecting one aspect of the present invention comprises: a first conveyance member that is provided upstream of the conveyance path; a guide member that is disposed, along the conveyance path, downstream of the first conveyance member in the conveying direction; and a second conveyance member that is disposed downstream of the guide member in the conveying direction and conveys the envelope guided by the guide member, downstream in the conveying direction, wherein the guide member has a flapper relief that has retracted away from the conveyance path such that a rise portion of the flapper generated due to the curve of the conveyance path passes through the flapper relief.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 4A1 to 4D3 explanatorily illustrate a case where as a sheet S, an envelope having a flapper F folded passes through a curved conveyance path in the embodiment;

FIGS. 9A1 to 9D3 explanatorily illustrate a case where an envelope E having a flapper F fold passes through a curved conveyance path in a conventional technique;

FIG. 9E illustrates the envelope E having the flapper F folded; and

FIG. 9F is a cross-sectional view of the envelope E that is conveyed along the curved conveyance path.

DETAILED DESCRIPTION OF EMBODIMENTS

Hereinafter, one or more embodiments of an image forming apparatus 10 according to the present invention will be described with reference to the drawings. However, the scope of the invention is not limited to the disclosed embodiments.

1 Embodiment

1.1 Configuration of Image Forming Apparatus 10

Figure 1:
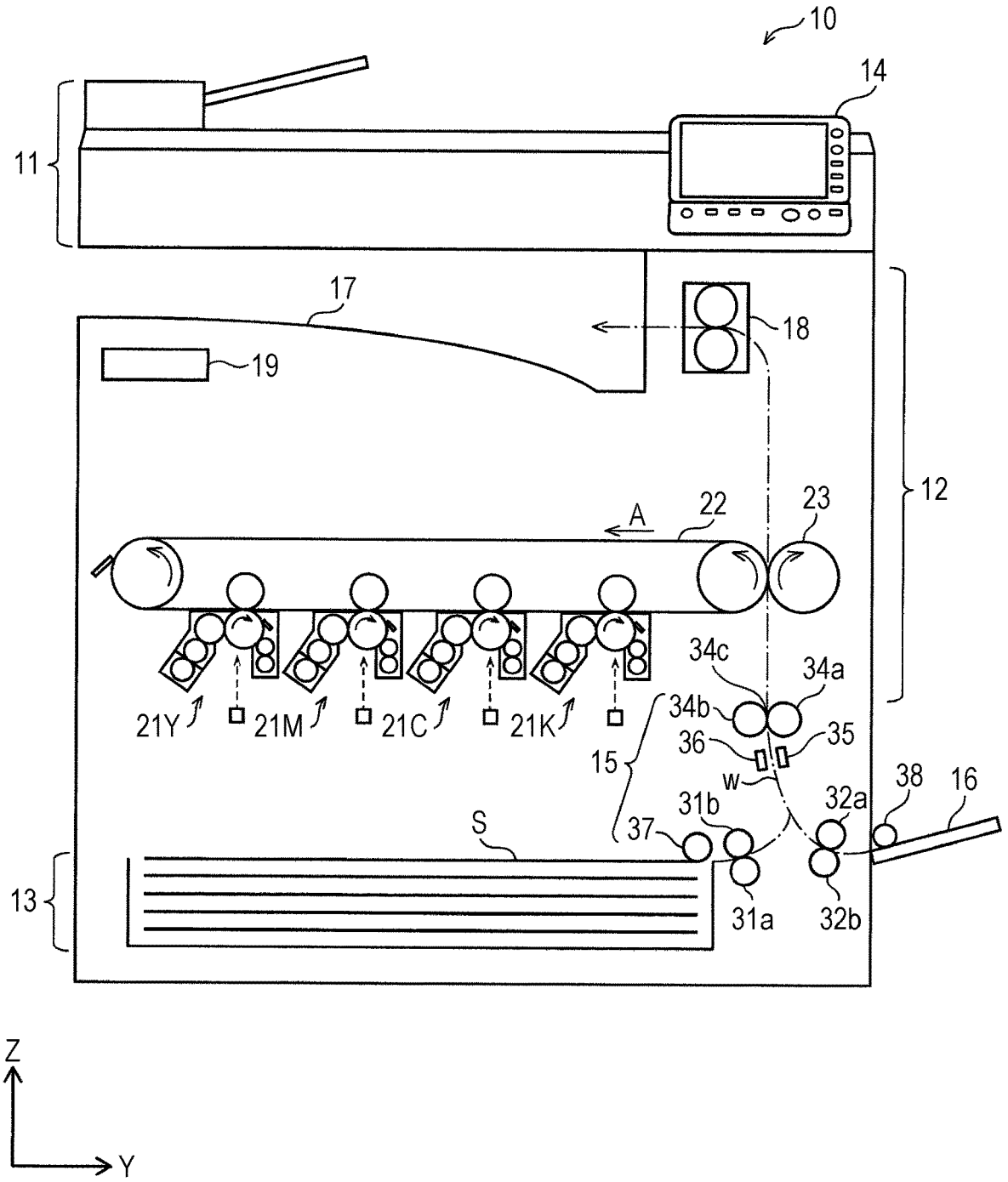
FIG. 1 is a schematic cross-sectional view illustrating a primary configuration of an image forming apparatus as an embodiment.

As illustrated in FIG. 1, the image forming apparatus 10 is a so-called tandem color copier.

The image forming apparatus 10 forms an image on, for example, a plain sheet and an envelope having a flapper.

In the image forming apparatus 10, provided are a sheet feeder 13 at a lower portion of the housing and a print engine 12 above the sheet feeder 13. The sheet feeder 13 accommodates and feeds sheets, and the print engine 12 forms an image by an electrophotographic method. Each sheet is conveyed from the sheet feeder 13 toward the print engine 12 via a conveyance path W. Further above the print engine 12, provided are a scanner 11 and an operation panel 14. The scanner 11 reads a document face and the operation panel 14 displays an operation screen and receives an input operation from a user.

The scanner 11 includes an automatic document conveying device. The automatic document conveying device conveys documents that are set on a document tray one by one to a document glass plate. The scanner 11 scans (reads), by movement of a reader an image of each document that has been conveyed to a predetermined position on the document glass plate by the automatic document conveying device. Then, the scanner 11 obtains image data including multi-value digital signals of red (R), green (G), and blue (B).

Respective pieces of image data of the color components obtained by the scanner 11 are subjected to various types of data processing at a control circuit 19. Further, the processed images are converted into respective pieces of image data in reproduced colors of yellow (Y), magenta (M), cyan (C), and black (K).

The print engine 12 includes, for example, an intermediate transfer belt 22, a driving roller and a driven roller that lay the intermediate transfer belt 22, a plurality of image forming units 21Y, 21M, 21C, and 21K, and a fixer 18. The plurality of image forming units 21Y, 21M, 21C, and 21K each are disposed opposite to the intermediate transfer belt 22 at a predetermined interval, along the traveling direction A of the intermediate transfer belt 22.

Each image forming unit includes, for example, a photoconductor drum that serves as an image carrier, a light emitting diode (LED) array that exposes and scans the front face of the photoconductor drum, an electrostatic charger, a developing device, a cleaner, and a primary transfer roller.

The sheet feeder 13 includes a sheet feeding cassette that accommodates the sheets and a pickup roller 37, a manual feeding tray 16 on which sheets are placed, and a pickup roller 38. The pickup roller 37 sends out each sheet from the sheet feeding cassette to the conveyance path W, and the pickup roller 38 sends out each sheet from the manual feeding tray 16 to the conveyance path W.

At each image forming unit, the photoconductor drum is uniformly charged by the electrostatic charger, exposed by the LED array, and an electrostatic latent image is formed on the front face of the photoconductor drum. Each electrostatic latent image is developed by the developing device for the corresponding color, and a toner image in any color of Y, M, C, and K is formed on the front face of the photoconductor drum. The toner images each are sequentially transferred onto the front face of the intermediate transfer belt by electrostatic action of the primary transfer roller that is provided on the back face side of the intermediate transfer belt.

Along the conveyance path W, provided are sheet feeding rollers 31*a* and 31*b* (first conveyance members), a guide member 35, a guide member 36, registration rollers 34*a* and 34*b* (second conveyance members) in this order downstream of the sheet feeder 13 in the sheet conveying direction. Further, along a conveyance path from the manual feeding tray 16, provided are sheet feeding rollers 32*a* and 32*b* downstream of the manual feeding tray 16 in the sheet conveying direction. The conveyance path joins the conveyance path W from the sheet feeder 13. Here, the sheet feeding roller 31*a* and the sheet feeding roller 31*b* are in press contact with each other, and the sheet feeding roller 32*a* and the sheet feeding roller 32*b* are in press contact with each other. The registration roller 34*a* and the registration roller 34*b* are in press contact with each other. Here, the sheet feeding rollers 31*a* and 31*b*, the guide member 35, the guide member 36, and the registration rollers 34*a* and 34*b* provided along the conveyance path W are included in a conveying device 15.

The conveyance path W is curved between the sheet feeding rollers 31*a* and 31*b* and between the registration rollers 34*a* and 34*b*. With this arrangement, along the curved conveyance path W, conveyed is an envelope having a flapper simply folded, the envelope being non-sealed, the envelope having a side where the flapper is present, the side being in agreement with the conveying direction, the envelope having a front face where the folded flapper is present, the front face being directed outside the curve of the conveyance path W.

The guide member 35 has a groove recessed therein. The groove retracts away from the conveyance path W such that a rise portion of the flapper generated due to the curve of the conveyance path W passes the groove.

The conveying distance between the sheet feeding rollers 31*a* and 31*b* and the registration rollers 34*a* and 34*b* is equal to the length in the conveying direction of the envelope.

The sheet feeding rollers 31*a* and 31*b* or the sheet feeding rollers 32*a* and 32*b* convey each sheet in accordance with the image forming operation by each image forming unit, from the sheet feeding cassette of the sheet feeder 13 or the manual feeding tray 16 toward a nip 34*c* formed by the registration rollers 34*a* and 34*b*, via the guide member 35 and the guide member 36.

The registration rollers 34*a* and 34*b* correct skew of the sheet that has been conveyed from the sheet feeding rollers 31*a* and 31*b* or the sheet feeding rollers 32*a* and 32*b*, and adjust timing of conveying the skew-corrected sheet. Then, the registration rollers 34*a* and 34*b* convey the skew-corrected sheet to a secondary transfer position where a secondary transfer roller 23 and a backup roller opposite to each other with the intermediate transfer belt 22 interposed between the secondary transfer roller 23 and the backup roller.

At the secondary transfer position, the respective toner images in Y, M, C, and K colors on the intermediate transfer belt 22 are secondarily transferred onto the sheet by electrostatic action of the secondary transfer roller 23. The sheet on which the respective toner images in Y, M, C and K colors are secondarily transferred is further conveyed to the fixer 18.

When the sheet passes through a fixing nip formed between a heating roller and a pressure roller of the fixer 18, the heating roller and a pressure roller being in press contact with each other, the toner image on the front face of the sheet is fused and fixed on the front face of the sheet by heating and pressing. After passing through the fixer 18, the sheet is sent to a discharge tray 17.

1.2 Guide Member 35

Figure 2A:
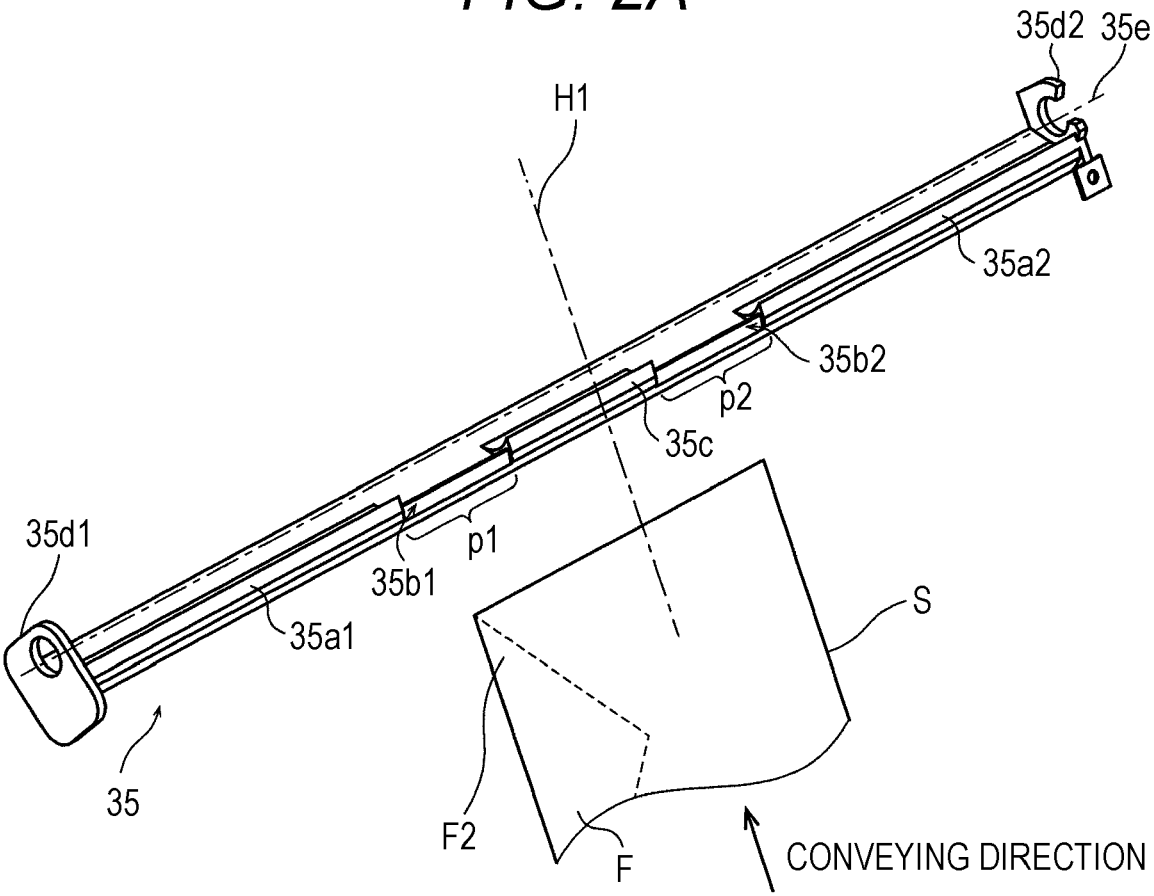
FIG. 2A is an external perspective view of a guide member.
Figure 2B:
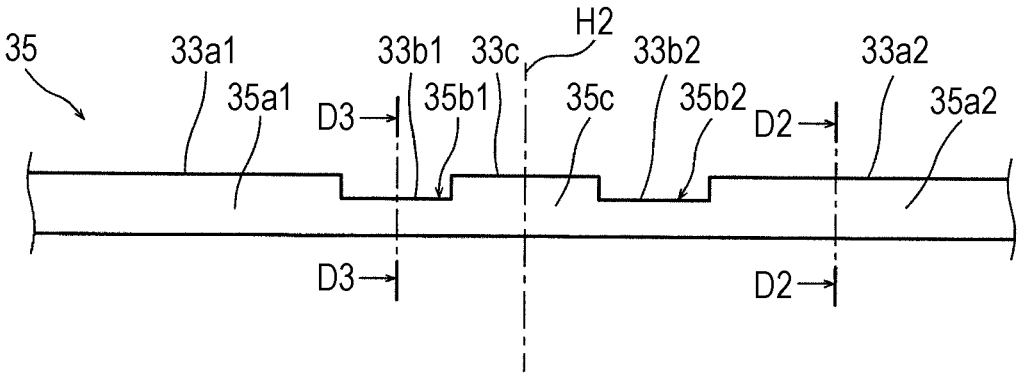
FIG. 2B is a schematic front view of the guide member viewed from the sheet S side.
Figure 3A:
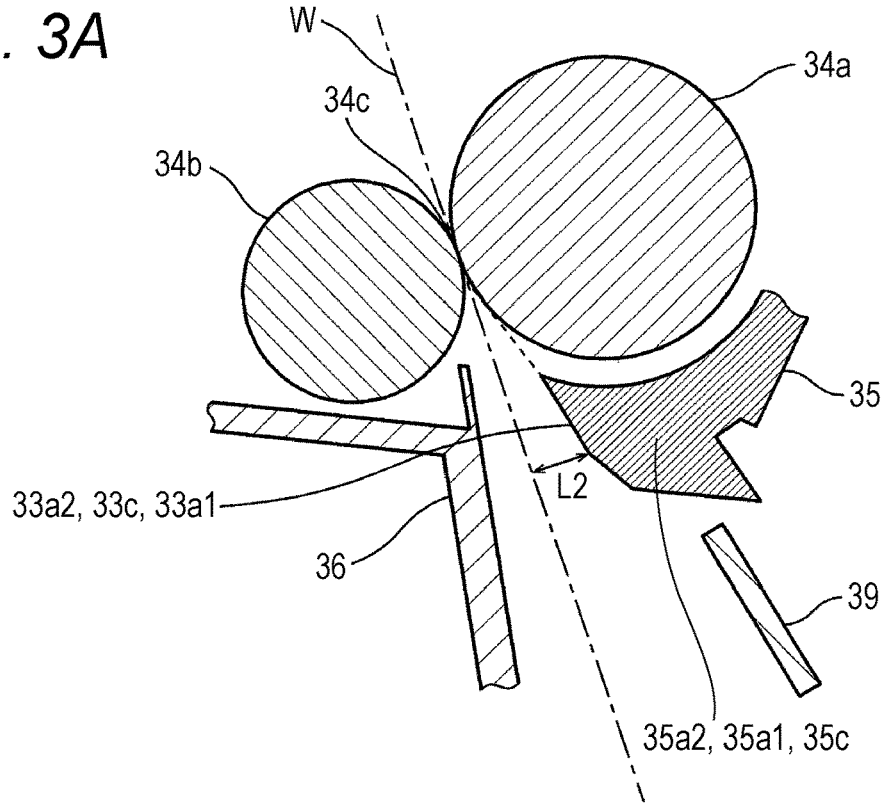
FIG. 3A is a cross-sectional view for a guide portion of the guide member, and the cross-sectional view also illustrates registration rollers and guide members.
Figure 3B:
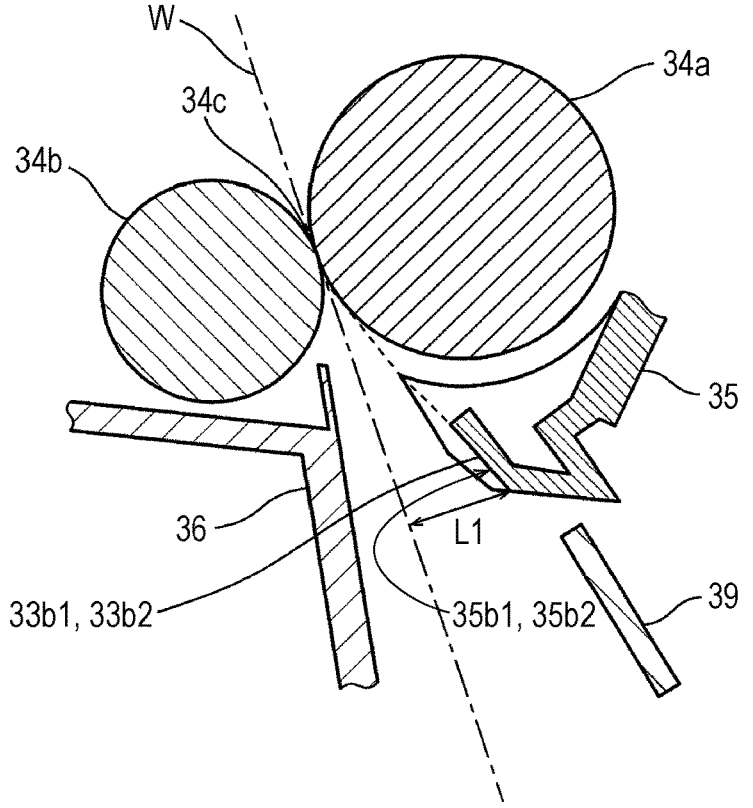
FIG. 3B is a cross-sectional view for a groove of the guide member, and the cross-sectional view also illustrates the registration rollers and the guide members.

FIG. 2A is an external perspective view of the guide member 35. FIG. 2A also illustrates the conveying direction of a sheet S. FIG. 2B is a schematic front view of the guide member 35 viewed from the sheet S side. FIG. 3A is a cross-sectional view of the guide member 35 and the other members, viewed along arrows D2-D2 in FIG. 2B. FIG. 3B is a cross-sectional view of the guide member 35 and the other members, viewed along arrows D3-D3 in FIG. 2B.

As illustrated in FIG. 2A, the guide member 35 is elongate in a direction orthogonal to the conveying direction of the sheet S. The guide member 35 guides the sheet S that is conveyed from the sheet feeding rollers 31*a* and 31*b* or the sheet feeding rollers 32*a* and 32*b* to the nip 34*c* between the registration rollers 34*a* and 34*b*. Here, the guide member 35 and the registration roller 34*a* are disposed on the same side with respect to the conveyance path W.

The guide member 35 is supported swingably around a shaft 35*e*. The shaft 35*e* also serves as the shaft that supports the registration roller 34*a*. That is, the guide member 35 is supported pivotably around the rotary shaft of the registration roller 34*a*. As described above, the guide member 35 is supported swingably around the shaft 35*e*. Thus, even in a case where a thick sheet enters the guide member 35, the guide member 35 swings, due to the entry of the thick sheet, around the shaft 35*e* within a swinging range of the guide member 35. The swinging by the guide member 35 can prevent the front end of the thick sheet from abutting the guide member 35 and stopping. As a result, the guide member 35 can stably guide the thick sheet to the nip 34*c* between the registration rollers 34*a* and 34*b*.

The guide member 35 includes a guide portion 35*a*1, a guide portion 35*c*, and a guide portion 35*a*2.

At a position P1 (FIG. 2A) where a rise portion F2 of the flapper (including gaps E6 and E7 in FIG. 9F) passes, a groove 35*b*1 (flapper relief) is recessed in a vertically downward cut-out face of the guide member 35, the groove 35*b*1 penetrating in the direction of the conveyance path W. In FIG. 2A, the rise portion F2 of the flapper passes left with respect to a center line H1.

Further, in preparation for a case where the rise portion of the flapper passes right with respect the center line H1 in the direction opposite to the conveying direction of the envelope illustrated in FIG. 2A, at a position P2 where the rise portion of the flapper passes, a groove 35*b*2 is recessed in a vertically downward cut-out face of the guide member 35, the groove 35*b*2 penetrating in the direction of the conveyance path W.

The groove 35*b*1 is recessed between the guide portion 35*a*1 and the guide portion 35*c* in the elongate direction of the guide member 35. The groove 35*b*2 is recessed between the guide portion 35*c* and the guide portion 35*a*2 in the elongate direction of the guide member 35. That is, in the guide member 35, the groove 35*b*1 is recessed on the left side and the groove 35*b*2 is recessed on the right side, with respect to the center line H1 (H2).

The guide portion 35*a*1, the guide portion 35*c*, and the guide portion 35*a*2 have a guide face 33*a*1, a guide face 33*c*, and a guide face 33*a*2 that guide the sheet S, respectively (FIG. 2B). Here, the guide faces 33*a*1, 33*c*, and 33*a*2 each have a planar shape. The guide portion 35*a*1, the guide portion 35*c*, and the guide portion 35*a*2 have the guide faces 33*a*1, 33*c*, and 33*a*2, respectively, such that the nip 34*c* between the registration rollers 34*a* and 34*b* is located on the extension of the guide faces 33*a*1, 33*c*, and 33*a*2.

The guide faces 33*a*1, 33*c*, and 33*a*2 each guide the sheet S.

The groove 35*b*1 and the groove 35*b*2 have a bottom face 33*b*1 and a bottom face 33*b*2, respectively (FIG. 2B). Here, the bottom face 33*b*1 and the bottom face 33*b*2 each have a planar shape (FIG. 3B). The groove 35*b*1 and the groove 35*b*2 are provided such that the nip 34*c* between the registration rollers 34*a* and 34*b* is located on the extension of the bottom face 33*b*1 and the bottom face 33*b*2.

As described above, the nip 34*c* between the registration rollers 34*a* and 34*b* is located on the extension of the guide faces 33*a*1, 33*c*, and 33*a*2, and the nip 34*c* is located on the extension of the bottom face 33*b*1 and the bottom face 33*b*2. Thus, the respective angles of the bottom face 33*b*1 and the bottom face 33*b*2 to the conveyance path W are different from the respective angles of the guide faces 33*a*1, 33*c*, and 33*a*2 to the conveyance path W.

Of the flapper face, the rise portion of the flapper passes through the space between the bottom face 33*b*1 (or bottom face 33*b*2) and the conveyance path W.

As illustrated in FIGS. 3A and 3B, the groove 35*b*1 and the groove 35*b*2 are defined in depth such that a first distance L1 between the bottom face 33*b*1 (or bottom face 33*b*2) and the conveyance path W is longer than a second distance L2 between the guide face 33*a*2 (or guide face 33*c*, or the guide face 33*a*1) and the conveyance path W.

1.3 Example of Conveying Sheet S

As described above, from the sheet feeder 13 that horizontally accommodates the sheet S as the envelope, the sheet feeding rollers 31*a* and 31*b* convey the sheet S vertically and upward via the curved conveyance path W. The guide members 35 and 36 guide the sheet S, and the sheet is conveyed toward the nip 34*c* formed by the registration rollers 34*a* and 34*b*. Hereinafter, the conveyance in this case will be described with reference to FIGS. 4A1 to 4D3.

FIG. 4A1 is a schematic cross-sectional view of the guide member 35 and the other members, viewed along arrows A1-A1 in FIG. 4A3. FIG. 4A2 is a schematic cross-sectional view of the guide member 35 and the other members, viewed along arrows A2-A2 in FIG. 4A3. FIG. 4B1 is a schematic cross-sectional view of the guide member 35 and the other members, viewed along arrows A3-A3 in FIG. 4B3. FIG. 4B2 is a schematic cross-sectional view of the guide member 35 and the other members, viewed along arrows A4-A4 in FIG. 4B3. FIG. 4C1 is a schematic cross-sectional view of the guide member 35 and the other members, viewed along arrows A5-A5 in FIG. 4C3. FIG. 4C2 is a schematic cross-sectional view of the guide member 35 and the other members, viewed along arrows A6-A6 in FIG. 4C3. FIG. 4D1 is a schematic cross-sectional view of the guide member 35 and the other members, viewed along arrows A7-A7 in FIG. 4D3. FIG. 4D2 is a schematic cross-sectional view of the guide member 35 and the other members, viewed along arrows A8-A8 in FIG. 4D3.

Here, in FIGS. 4A1, 4A2, 4B1, 4B2, 4C1, 4C2, 4D1, and 4D2, similarly to FIGS. 9A1, 9A2, 9B1, 9B2, 9C1, 9C2, 9D1, and 9D2, the envelope being conveyed in a curved posture is straightened, in order to clearly illustrate a floating degree of the flapper F.

When the sheet S is fed from the sheet feeder 13, the sheet feeding rollers 31*a* and 31*b* convey the sheet S having the flapper F toward the registration rollers 34*a* and 34*b* as illustrated in FIGS. 4A1 to 4A3, while the sheet S is present in the curved conveyance path W.

When the sheet S is further conveyed toward the registration rollers 34*a* and 34*b*, as illustrated in FIGS. 4B1 to 4B3, even though the flapper F is open, the front end S5 of the sheet S enters space in the groove 35*b*1 (or the groove 35*b*2). Thus, unlike a flat configuration having no groove, the sheet S dose not receive conveying resistance from the guide member.

Although the flapper F of the sheet S is open, of both sides S6 and S7 of the sheet S, the thickness of the side S7 where the sheet S has the flapper F is thinner than the interval between the groove 35*b*1 and the guide member 36 (FIGS. 4C1 to 4C3). When the sheet S is further conveyed toward the registration rollers 34*a* and 34*b*, as illustrated in FIGS. 4C1 to 4C3, the side S7 where the envelope E has the flapper F does not receive resistance from the groove 35*b*1 and the guide member 36. In addition, the side S6 where the envelope E does not have the flapper F is conveyed toward the registration rollers 34*a* and 34*b* without receiving the resistance from the groove 35*b*1 and the guide member 36.

When the sheet S is further conveyed toward the registration rollers 34*a* and 34*b*, as illustrated in FIGS. 4D1 to 4D3, the side S7 where the envelope E has the flapper F does not receive resistance from the groove 35*b*1 and the guide member 36, and the front end of the side S7 comes into contact with the registration rollers 34*a* and 34*b*. In addition, the front end of the side S6 where the envelope E does not have the flapper F comes into contact with the registration rollers 34*a* and 34*b*.

As described above, while the sheet S as the envelope is present in the curved conveyance path W, when the sheet S is conveyed toward the registration rollers 34*a* and 34*b*, even though the flapper is open, the sheet S as the envelope does not skew. No skew occurs, so that an image is correctly formed on a face of the sheet S.

1.4 Brief of the Embodiment

From the sheet feeder 13 that horizontally accommodates the sheet S as the envelope having the flapper face downward, the sheet feeding rollers 31*a* and 31*b* convey the sheet S vertically and upward via the curved conveyance path W. Then, the sheet S is guided by the guide member 35 and the guide member 36, and then conveyed toward the nip 34*c* formed by the registration rollers 34*a* and 34*b*.

In this case, when the sheet S passes through the curved conveyance path W, the flapper face of the envelope faces outside the curve of the conveyance path W. Thus, the flapper of the envelope is easy to open during the sheet S is passing through the conveyance path W.

However, as illustrated in FIGS. 2A and 2B, the groove 35*b*1 and the groove 35*b*2 are recessed in the dented guide faces of the guide member 35 present outside the curve of the curved conveyance path W, the dents being at the positions corresponding to portions where the flapper floats, the groove 35*b*1 and the groove 35*b*2 penetrating in the direction of the conveyance path W.

Further, as illustrated in FIGS. 3A and 3B, the groove 35*b*1 and the groove 35*b*2 are defined in depth such that the first distance L1 between the bottom face 33*b*1 (or the bottom face 33*b*2) and the conveyance path W is longer than the second distance L2 between the guide face 33*a*2 (or guide face 33*c*, or guide face 33*a*1) and the conveyance path W.

With this arrangement, as illustrated in FIGS. 4C1 to 4C3, although the flapper F of the sheet S is open, of both sides S6 and S7 of the sheet S, the thickness of the side S7 where the envelope E has the flapper F is narrower than the interval between the groove 35*b*1 and the guide member 36. Thus, the side S7 where the envelope E has the flapper F does not receive the resistance from the groove 35*b*1 and the guide member 36.

Therefore, while the sheet S as the envelope is present in the curved conveyance path W, in the case where the sheet S is conveyed toward the registration rollers 34*a* and 34*b*, even though the flapper of the envelope is open, the sheet S as the envelope does not skew. No skew occurs, so that the image is correctly formed on the face of the sheet S.

1.5 Modification (1)

In the above embodiment, as illustrated in FIG. 2A, the guide member 35 includes the guide portion 35*a*1, the guide portion 35*c*, and the guide portion 35*a*2, and the guide member 35 has the groove 35*b*1 and the groove 35*b*2 recessed in the guide member 35. However, this configuration is not limitative. The following configuration may be provided.

Figure 5A:
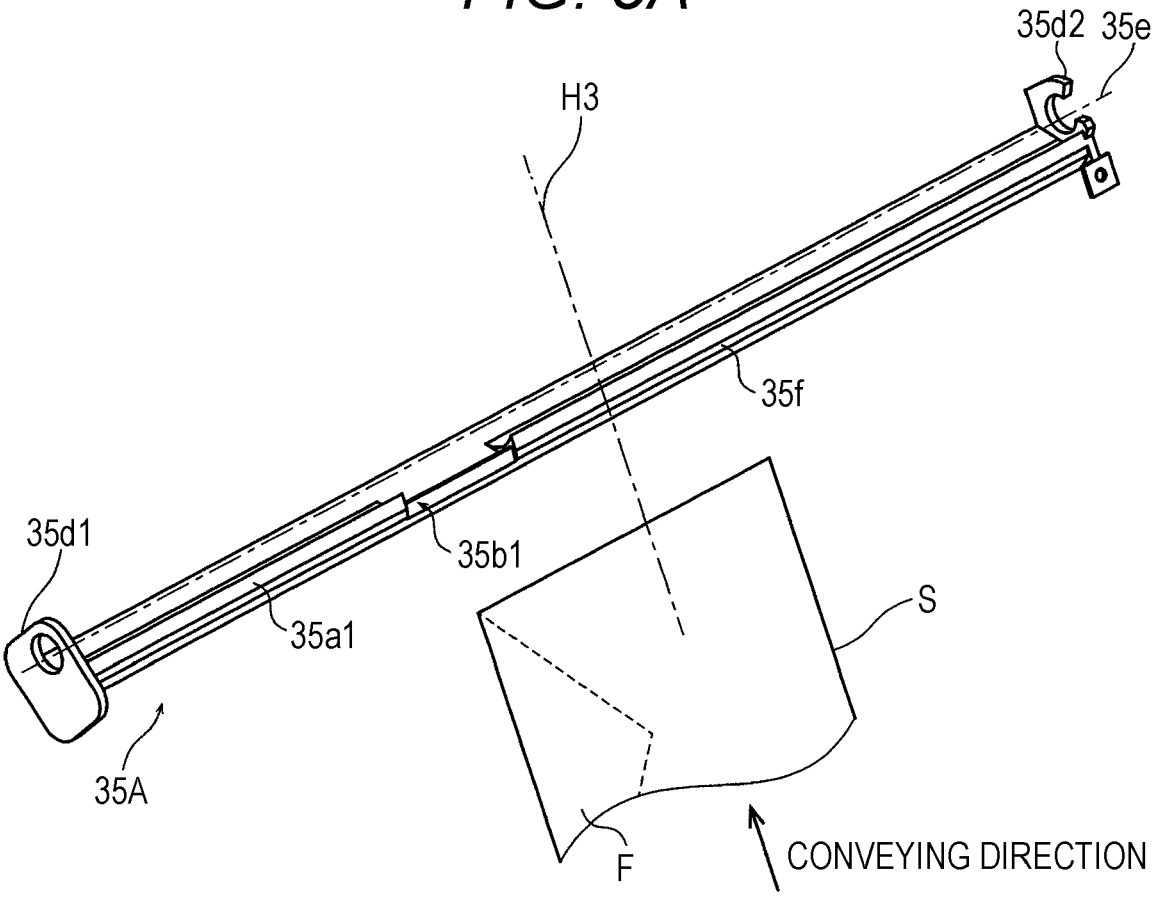
FIG. 5A is an external perspective view of a guide member as Modification (1)
Figure 5B:
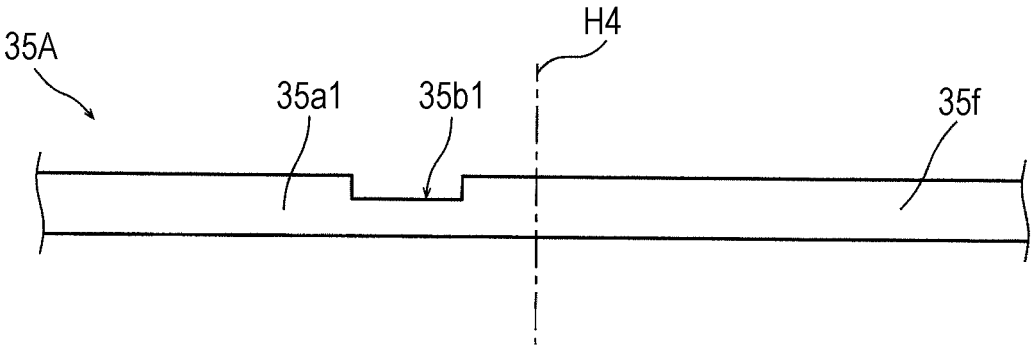
FIG. 5B is a schematic front view of the guide member viewed from the sheet S side.

In Modification (1) of the above embodiment, as illustrated in FIGS. 5A and 5B, a guide member 35A includes a guide portion 35*a*1 and a guide portion 35*f*, and the guide member 35A has a groove 35*b*1 recessed therein. The guide portions and the groove are as described in the embodiment.

Here, FIG. 5A is an external perspective view of the guide member 35A. FIG. 5A also illustrates the conveying direction of a sheet S. FIG. 5B is a schematic front view of the guide member 35A viewed from the sheet S side.

In the guide member 35A, the groove 35*b*1 is recessed on one side and no groove is present on the other side with respect to a center line H3 (H4).

In this case, for the sheet feeder 13, a direction where a sheet as an envelope having a flapper is accommodated is defined to be one. That is, a user needs to accommodate the envelope having the flapper in the sheet feeder 13 such that a side having the flapper of the envelope passes through the side where the groove 35*b*1 is present.

Even with such a configuration, while the sheet S as the envelope is present in the curved conveyance path W, in a case where the sheet S is conveyed toward the registration rollers 34*a* and 34*b*, even though the flapper of the envelope is open, the sheet S as the envelope dose not skew. No skew occurs, so that an image is correctly formed on the face of the sheet S.

1.6 Modifications (2)

In the above embodiment, as illustrated in FIG. 2A, the guide member 35 includes the guide portion 35*al*, the guide portion 35*c*, and the guide portion 35*a*2, and the guide member 35 has the groove 35*b*1 and the groove 35*b*2 recessed in the guide member 35. However, this configuration is not limitative. The following configuration may be provided.

Figure 6A:
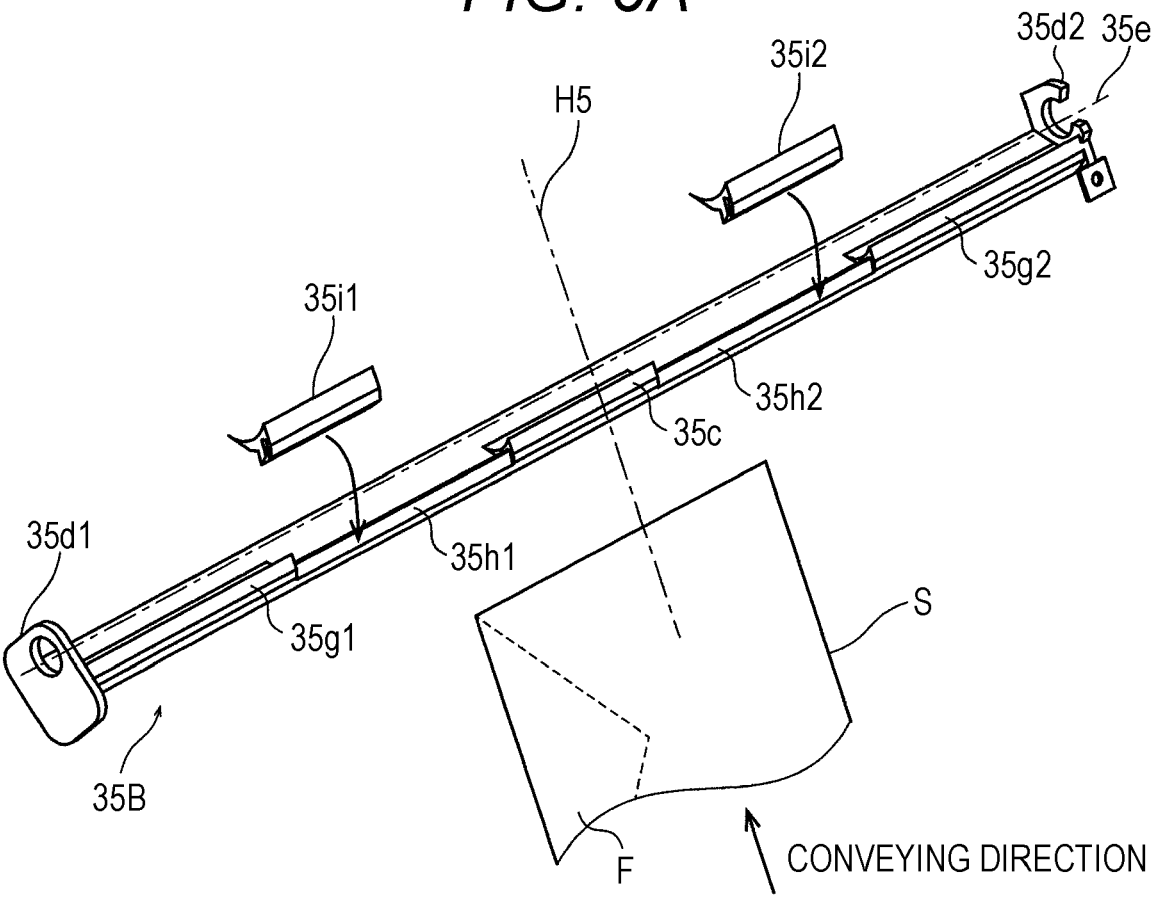
FIG. 6A is an external perspective view of a guide member as Modification (2)
Figure 6B:
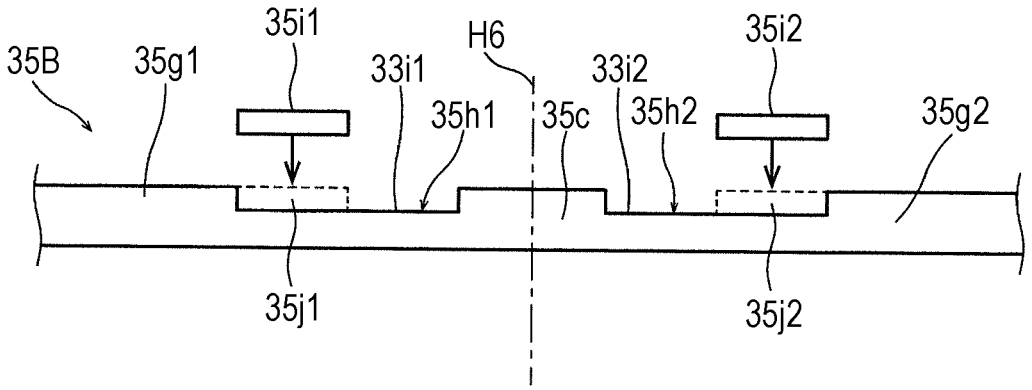
FIG. 6B is a schematic front view of the guide member viewed from the sheet S side.

In Modification (2) of the above embodiment, as illustrated in FIGS. 6A and 6B, a guide member 35B includes a guide portion 35*g*1, a guide portion 35*c*, and a guide portion 35*g*2, and the guide member 35B has a groove 35*h*1 and a groove 35*h*2 recessed in the guide member 35B. The guide portions and the grooves are as described in the embodiment.

FIG. 6A is a perspective view of the guide member 35B. FIG. 6A also illustrates the conveying direction of a sheet S. FIG. 6B is a schematic front view of the guide member 35B viewed from the sheet S side.

In the guide member 35B, the groove 35*h*1 is present on one side and the groove 35*h*2 is present on the other side with respect to a center line H5 (H6).

The groove 35*h*1 and the groove 35*h*2 have a bottom face 33*i*1 and a bottom face 33*i*2, respectively.

Modification (2) has a configuration similar to that of the embodiment in the description so far, and has an effect similar to that of the embodiment. Note that, one difference is in the respective widths of the grooves. The respective lengths of the groove 35*h*1 and the groove 35*h*2 in the elongate direction are longer than the respective lengths of the groove 35*b*1 and the groove 35*b*2 in the elongate direction in the above embodiment.

In Modification (2), an attachment 35*i*1 (projection member) and an attachment 35*i*2 (projection member) are prepared in advance.

The attachment 35*i*1 has the same cross-sectional shape as a protrusion obtained by cutting the guide portion 35*g*1 on the same plane as the bottom face 33*i*1.

The attachment 35*i*2 is similar to the attachment 35*i*1.

The attachment 35*i*1 can be disposed on the bottom face 33*i*1 such that a side face of the attachment 35*i*1 contacts a side face of the guide portion 35*g*1. The attachment 35*i*1 is screwed and fixed to the guide member 35B. As a result, a guide 35*j*1 is newly formed. Note that the attachment 35*i*1 may be disposed on the bottom face 33*i*1 such that another side face of the attachment 35*i*1 contacts a side face of the guide portion 35*c*.

Further, the attachment 35*i*2 can be disposed on the bottom face 33*i*2 such that a side face of the attachment 35*i*2 contacts a side face of the guide portion 35*g*2. The attachment 35*i*2 is screwed and fixed to the guide member 35B. As a result, a guide 35*j*2 is newly formed. Note that the attachment 35*i*2 may be disposed on the bottom face 33*i*2 such that another side face of the attachment 35*i*2 contacts another side face of the guide portion 35*c*.

The attachments are determined in disposition position corresponding to the size of an envelope to be used when the image forming apparatus 10 is used. That is, each attachment (guide plate) having a length shorter than the width of the groove is attachable into and detachable from the groove of the guide member, so that the position of the groove is shiftable in the elongate direction of the guide member.

The attachment 35*i*1 and the attachment 35*i*2 may be fixed before the image forming apparatus 10 is shipped from the factory. Alternatively, after the image forming apparatus 10 is shipped, a service person may fix the attachment 35*i*1 and the attachment 35*i*2 at the installation location (use location) of the image forming apparatus 10.

As described above, the respective disposition positions of the attachments are changeable. Thus, in the guide member 35B, the grooves can be suitably located corresponding to the size of the envelope to be used when the image forming apparatus 10 is used.

1.7 Modifications (3)

In the above embodiment, as illustrated in FIG. 2A, the guide member 35 includes the guide portion 35*a*1, the guide portion 35*c*, and the guide portion 35*a*2, and the guide member 35 has the groove 35*b*1 and the groove 35*b*2 recessed in the guide member 35. However, this configuration is not limitative. The following configuration may be provided.

Figure 7A:
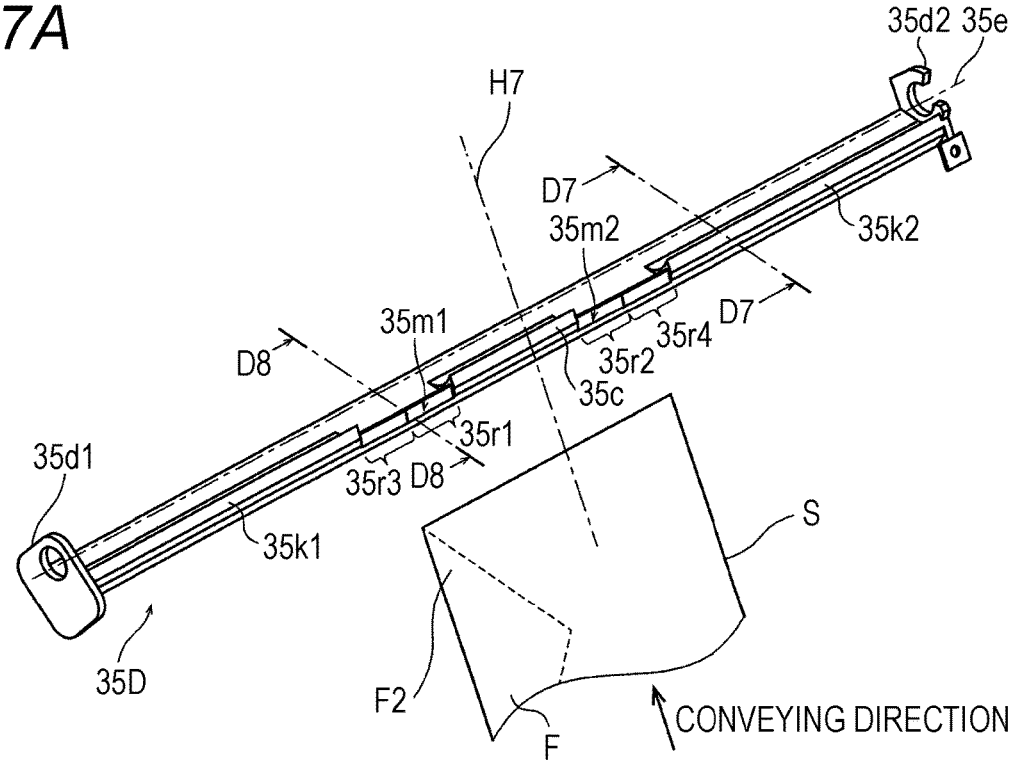
FIG. 7A is an external perspective view of a guide member as Modification (3)
Figure 7B:
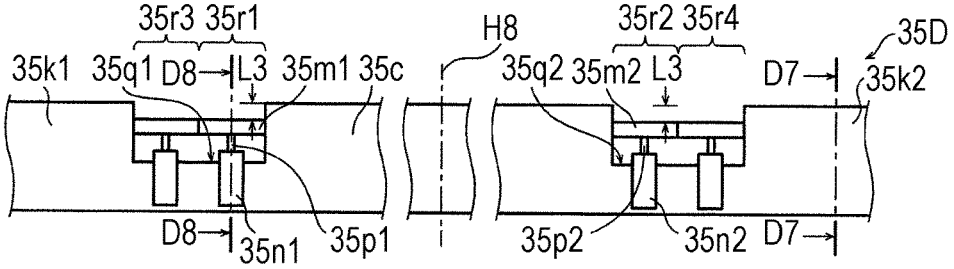
FIG. 7B is a schematic front view of the guide member viewed from the sheet S side.

In Modification (3) of the above embodiment, as illustrated in FIGS. 7A and 7B, a guide member 35D includes a guide portion 35*k*1, a guide portion 35*c*, and a guide portion 35*k*2. The guide member 35D also has a grooves 35*q*1 recessed on one side and a groove 35*q*2 recessed on the other side with respect to a line H8. The groove 35*q*1 is provided with slide mechanisms 35*r*1 and 35*r*3, and the groove 35*q*2 is provided with slide mechanisms 35*r*2 and 35*r*4.

Here, the guide portion 35*k*1, the guide portion 35*c*, and the guide portion 35*k*2 are fixed guides having the same structure as the guide portion 35*a*1, the guide portion 35*c*, and the guide portion 35*a*2 of the embodiment, respectively. On the other hand, each of the slide mechanisms 35*r*1 to 35*r*4 has a variable guide slidably provided therewith.

FIG. 7A is a perspective view of the guide member 35D. FIG. 7A also illustrates the conveying direction of a sheet S.

Figure 7C:
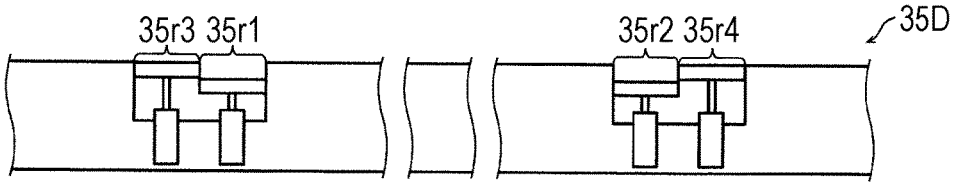
FIG. 7C is a schematic front view of the guide member in a first state viewed from the sheet S side.
Figure 7D:
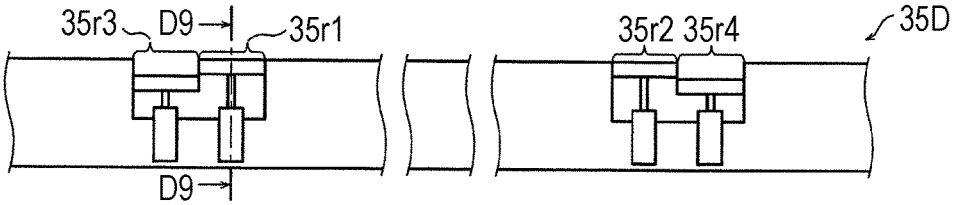
FIG. 7D is a schematic front view of the guide member in a second state viewed from the sheet S side.
Figure 7E:
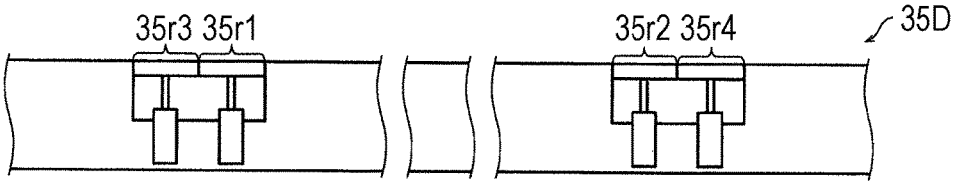
FIG. 7E is a schematic front view of the guide member in a third state viewed from the sheet S side.

FIG. 7B is a front view of the guide member 35D viewed from the sheet S side. FIG. 7C is a front view of the guide member 35D in a first state viewed from the sheet S side. FIG. 7D is a front view of the guide member 35D in a second state viewed from the sheet S side. FIG. 7E is a front view of the guide member 35D in a third state viewed from the sheet S side. Note that, in FIG. 7A, for simplicity, the description of the slide mechanisms described later is omitted.

The first state is a case where an envelope having a first width is conveyed to a conveyance path W. The second state is a case where an envelope having a second width is conveyed to the conveyance path W. The first width is narrower than the second width. Further, the third state is a case where a plain sheet is conveyed to the conveyance path W.

Figure 8A:
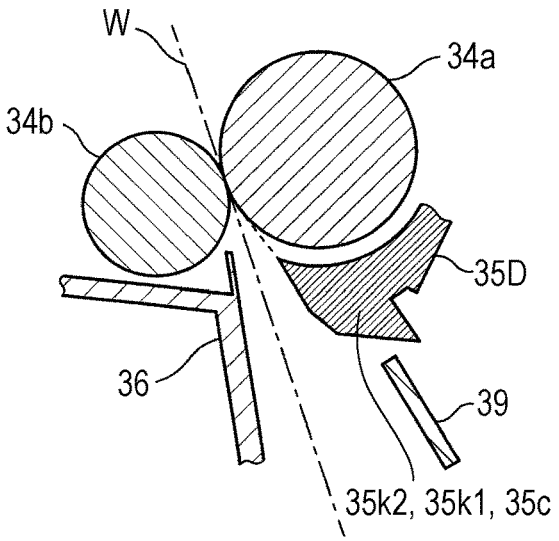
FIG. 8A is a cross-sectional view for a guide portion of the guide member, and the cross-sectional view also illustrates registration rollers and guide members.
Figure 8B:
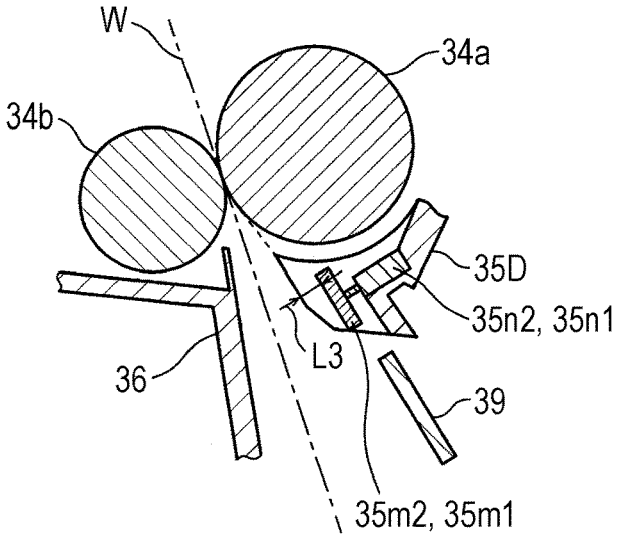
FIGS. 8B and 8C are cross-sectional views for, for example, a guide portion of the guide member, and the cross-sectional views also illustrate the registration rollers and the guide members.
Figure 8C:
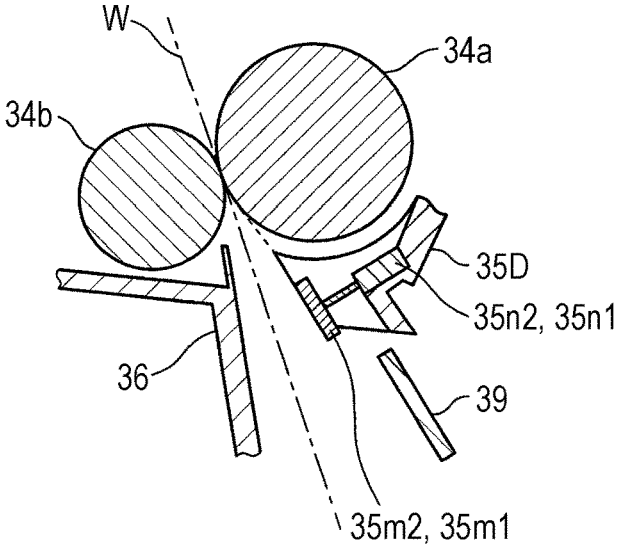

FIG. 8A is a cross-sectional view of the guide member 35D and the other members, viewed along arrows D7-D7 in FIG. 7B. FIG. 8B is a cross-sectional view of the guide member 35D and the other members, viewed along arrows D8-D8 in FIG. 7B. FIG. 8C is a cross-sectional view of the guide member 35D and the other members, viewed along arrows D9-D9 in FIG. 7D.

As illustrated in FIG. 7B, the slide mechanism 35*r*1 has a solenoid 35*n*1 disposed on the bottom face of the groove 35*q*1, and a tabular guide portion 35*m*1 (guide plate) is fixed to the leading end of a plunger 35*p*1 that protrudes from the solenoid 35*n*1. The guide portion 35*m*1 is a variable guide slidably provided. The slide mechanism 35*r*3 has the same configuration as the slide mechanism 35*r*1.

Further, the slide mechanism 35*r*2 has a solenoid 35*n*2 disposed on the bottom face of the groove 35*q*2, and a tabular guide portion 35*m*2 (guide plate) is fixed to the leading end of a plunger 35*p*2 that protrudes from the solenoid 35*n*2. The guide section 35*m*2 is a variable guide slidably provided. The slide mechanism 35*r*4 has the same configuration as the slide mechanism 35*r*2.

In a case where a plain sheet is conveyed to the conveyance path W, as illustrated in FIG. 7E, under control by the control circuit 19, the solenoid 35*n*1 of the slide mechanism 35*r*1 causes the plunger 35*p*1 to protrude to a position where the front face of the guide portion 35*m*1 agrees with the front face of the guide portion 35*k*1 and the solenoid 35*n*2 of the slide mechanism 35*r*2 causes the plunger 35*p*2 to protrude to a position where the front face of the guide portion 35*m*2 agrees with the front face of the guide portion 35*k*2. The similar manner is applied to the slide mechanisms 35*r*3 and 35*r*4.

Further, in a case where an envelope having the first width (narrow width) is conveyed to the conveyance path W, as illustrated in FIG. 7C, under control by the control circuit 19, the solenoid 35*n*1 of the slide mechanism 35*r*1 retracts the plunger 35*p*1 such that the difference between the front face of the guide portion 35*m*1 and the front face of the guide portion 35*k*1 is a distance L3 and the solenoid 35*n*2 of the slide mechanism 35*r*2 retracts the plunger 35*p*2 such that the difference between the front face of the guide portion 35*m*2 and the front face of the guide portion 35*k*2 is the distance L3. On the other hand, the solenoid of the slide mechanism 35*r*3 causes the guide portion to protrude, and the solenoid of the slide mechanism 35*r*4 causes the guide portion to protrude.

Further, in case where an envelope having the second width (wide width) is conveyed to the conveyance path W, as illustrated in FIG. 7D, under control by the control circuit 19, the solenoid 35*n*1 of the slide mechanism 35*r*1 causes the guide portion 35*m*1 to protrude and the solenoid 35*n*2 of the slide mechanism 35*r*2 causes the guide portion 35*m*2 to protrude. On the other hand, the solenoid of the slide mechanism 35*r*3 retracts the guide portion, and the solenoid of the slide mechanism 35*r*4 retracts the guide portion.

As described above, the grooves 35*q*1 and 35*q*2 penetrating in the conveying direction each are provided at the position where the rise portion of the flapper of the envelope passes through on the guide member 35D. The guide portion 35*m*1 (guide plate), the other guide portion, and the like are slidably provided inside the groove 35*q*1 in the depth direction of the groove 35*q*1. The guide portion 35*m*2 (guide plate), the other guide portion, and the like are slidably provided inside the groove 35*q*2 in the depth direction of the groove 35*q*2. In a case where the guide portion 35*m*1, the guide portion 35*m*2, and the like slide away from the conveyance path, the groove 35*q*1, the guide portion 35*m*1, and the like form a flapper relief that allows the generated rise portion of the flapper to pass through the flapper relief. Thus, at the guide member 35D, the flapper relief is shiftable in the elongate direction of the guide member 35D.

Further, the guide portions 35*m*1, 35*m*2, and the like (guide plates), are slidable between the position where the respective front faces of the guide portions 35*m*1, 35*m*2, and the like (guide plates) agree with the guide face of the guide portion 35*k*1 (e.g., FIG. 7E) and the position where the guide portions 35*m*1, 35*m*2, and the like are retracted such that the rise portion of the flapper passes through the position where the guide portions 35*m*1, 35*m*2, and the like are retracted (e.g., FIG. 7B).

Here, the distance L3 may be set to a maximum width in which the flapper of the envelope opens or a width slightly wider than the maximum width, in a case where the envelope is conveyed along the curved conveyance path W.

As described above, according to Modification (3), in the case where the envelope is conveyed to the conveyance path W, the solenoids 35*n*1 and 35*n*2 retract the plungers 35*p*1 and 35*p*2, respectively, such that the difference between the respective front faces of the guide portion 35*m*1 and the guide portion 35*m*2 and the respective front faces of the guide portions 35*k*1, 35*c*, and 35*k*2 is the distance L3. Thus, the envelope does not skew during the conveyance of the envelope.

Further, according to Modification (3), even in the case where there are the two types of the envelopes different in width to be conveyed to the conveyance path W, the grooves are recessed corresponding to each width, so that skew of the envelope can be prevented.

Furthermore, according to Modification (3), in the case where the plain sheet is conveyed to the conveyance path W, the respective solenoids of all the slide mechanisms cause the corresponding plungers to protrude to the position where the respective front faces of the guide portion 35*m*1 and the guide portion 35*m*2 agree with the respective front faces of the guide portion 35*k*1, 35*c*, and 35*k*2. Thus, there is no hindrance in the conveyance of the plain sheet.

2 Other Modifications

The present invention has been described on the basis of the above embodiment; however, the present invention is not limited to the above embodiment. The followings may be performed.

(1) In the above embodiment, as illustrated in FIGS. 2A and 2B, the groove is recessed on each side with respect to the center line H1 (H2). However, this arrangement is not limitative.

Two or more grooves may be recessed on each side with respect to the center line H1 (H2). With this arrangement, even in a case where a plurality of types of envelopes different in width is conveyed along the conveyance path W, skew of the individual envelopes different in width can be prevented.

Similarly, in Modification (1), two or more grooves may be recessed on one side with respect to the center line H3 (H4).

(2) Any combination may be made among the above embodiment and the above modifications.

The conveying device according to the present invention exerts an excellent effect that, in a case where an envelope passes through a curved path, skew of the envelope can be prevented. Thus, the conveying device is useful as a technique of passing an envelope through a curved conveyance path in an image forming apparatus.

Although embodiments of the present invention have been described and illustrated in detail, the disclosed embodiments are made for purposes of illustration and example only and not limitation. The scope of the present invention should be interpreted by terms of the appended claims

What is claimed is:

1. A conveying device that conveys an envelope along a curved conveyance path, the envelope having a flapper simply folded, the envelope being non-sealed, the envelope having a side where the flapper is present, the side being in agreement with a conveying direction, the envelope having a front face where the folded flapper is present, the front face being directed outside the curve of the conveyance path, the conveying device comprising:

a first conveyance member that is provided upstream of the conveyance path;

a guide member that is disposed, along the conveyance path, downstream of the first conveyance member in the conveying direction; and a second conveyance member that is disposed downstream of the guide member in the conveying direction and conveys the envelope guided by the guide member, downstream in the conveying direction, wherein the guide member has a flapper relief such that a rise portion of the flapper generated due to the curve of the conveyance path passes through the flapper relief, and wherein, at the guide member, the flapper relief is shiftable in an elongate direction of the guide member.

2. The conveying device according to claim 1, wherein the second conveyance member includes a first roller and a second roller each having an elongate shape, the first roller and the second roller being in press contact with each other, and a nip between the first roller and the second roller is located on an extension of a front face of the flapper relief.

3. The conveying device according to claim 1, wherein a guide plate is detachably provided in the flapper relief.

4. The conveying device according to claim 1, wherein a groove penetrating in the conveying direction is provided at a position where the rise portion of the flapper passes through on the guide member, the groove being internally provided with a guide plate movably in a depth direction of the groove, and in a case where the guide plate moves away from the conveyance path, the groove and the guide plate form the flapper relief.

5. The conveying device according to claim 4, wherein the guide member has a guide face that guides the envelope, and the guide plate is movable between a position where a front face of the guide plate agrees with the guide face of the guide member and a position where the guide plate retracts such that the rise portion of the flapper passes through the position where the guide plate retracts.

6. The conveying device according to claim 1, wherein a conveying distance between the first conveyance member and the second conveyance member is equal to a length in the conveying direction of the envelope.

7. A conveying device that conveys an envelope along a curved conveyance path, the envelope having a flapper simply folded, the envelope being non-sealed, the envelope having a side where the flapper is present, the side being in agreement with a conveying direction, the envelope having a front face where the folded flapper is present, the front face being directed outside the curve of the conveyance path, the conveying device comprising:

a first conveyance member that is provided upstream of the conveyance path;

a guide member that is disposed, along the conveyance path, downstream of the first conveyance member in the conveying direction; and a second conveyance member that is disposed downstream of the guide member in the conveying direction and conveys the envelope guided by the guide member, downstream in the conveying direction, wherein the guide member has a flapper relief such that a rise portion of the flapper generated due to the curve of the conveyance path passes through the flapper relief, wherein the second conveyance member includes a first roller and a second roller each having an elongate shape, the first roller and the second roller being in press contact with each other, the guide member and the first roller are disposed on a same side with respect to the conveyance path, and the guide member is supported pivotably around a rotary shaft of the first roller.

8. The conveying device according to claim 1, wherein the envelope is of a diamond type.

9. An image forming apparatus comprising:

the conveying device according to claim 1; and an image former that forms an image on an envelope that the conveying device conveys.

* * * * *